US006379020B1

(12) United States Patent
Lewis et al.

(10) Patent No.: US 6,379,020 B1
(45) Date of Patent: Apr. 30, 2002

(54) PLUMBING TOOL

(76) Inventors: Steven E. Lewis; Franklin D. Lewis, both of 13865 Gymkhana Rd., Peyton, CO (US) 80831; David Littlefield, 33 N. Garo, Colorado Springs, CO (US) 80909

( * ) Notice: Subject to any disclaimer, the term of this patent is extended or adjusted under 35 U.S.C. 154(b) by 0 days.

(21) Appl. No.: 09/576,214

(22) Filed: May 23, 2000

Related U.S. Application Data

(60) Provisional application No. 60/139,272, filed on Jun. 15, 1999.

(51) Int. Cl.[7] ..... B25B 23/18
(52) U.S. Cl. ..... 362/120; 362/190
(58) Field of Search ..... 362/120, 119, 362/396, 190, 191

(56) References Cited

U.S. PATENT DOCUMENTS

| | | | | | |
|---|---|---|---|---|---|
| 169,489 | A | | 11/1875 | Smeaton | 81/124.2 |
| 307,558 | A | | 11/1884 | Lindsley et al. | 137/367 |
| 394,733 | A | | 12/1888 | Staats et al. | 137/367 |
| 613,652 | A | | 11/1898 | Chadbourne | |
| 1,321,776 | A | | 11/1919 | Stepanian | 81/124.2 |
| 1,759,221 | A | | 5/1930 | Carson | 137/364 |
| 3,691,877 | A | | 9/1972 | Harris | 81/177.2 |
| 5,138,911 | A | | 8/1992 | Lan | 81/177.2 |
| 5,316,040 | A | | 5/1994 | Townsend et al. | 137/556 |
| 5,421,225 | A | * | 6/1995 | Chen | 80/490 |
| 5,794,644 | A | * | 8/1998 | Paylor | 137/15.17 |
| 6,116,747 | A | * | 9/2000 | Grawemmyer | 362/119 |
| 6,145,235 | A | * | 11/2000 | Emerson | 42/90 |

* cited by examiner

*Primary Examiner*—Alan Cariaso
*Assistant Examiner*—Hargobind S. Sawhney
(74) *Attorney, Agent, or Firm*—Richard C. Litman

(57) ABSTRACT

A versatile stopcock tool for installation of and adjusting flow in stop boxes for water, oil, gas and the like fluid materials. The tool is long with folding handles, has a telescopic shaft for storage and portage, and has specific heads for different functions. A flashlight can be removably clamped on the shaft.

12 Claims, 4 Drawing Sheets

PLUMBING TOOL

CROSS-REFERENCE TO RELATED APPLICATION

This application claims the benefit of U.S. Provisional Patent Application Ser. No. 60/139,272, filed Jun. 15, 1999.

BACKGROUND OF THE INVENTION

1. Field of the Invention

The present invention relates generally to a plumbing tool and, more specifically, to a versatile stop box tool with interchangeable heads for installation and cleaning of stop boxes and for flow adjustment of water, oil, gas and the like fluid materials via the stopcock. The tool is long with a folding handle, a telescopic shaft for storage and portage, and with removable heads for different functions. A removable flashlight can be clamped on the shaft of the plumbing tool.

2. Description of Related Art

There is a need for an economical and versatile plumbing tool with interchangeable heads which can install and clean stop boxes as well as adjust the flow of fluids via the stopcock. Since stopcock tools require lengthy shafts at times, a telescopic shaft and folding handles are advantageous for storage and portage. The addition of a removable flashlight clamped on the shaft would illuminate the work area. The related art of interest describes various plumbing tools, but none discloses the present invention.

The related art will be discussed in the order of perceived relevance to the present invention.

U.S. Pat. No. 5,316,040 issued on May 31, 1994, to Robert L. Townsend et al. describes a valve alignment tool for correctly aligning the valve box above each shutoff valve in the water pipes of an underground water main. The tool fits over the square stem nut of the gate valve. The top of the tool contains a bubble level. When the trench around the water main is filled, the valve is alignment tool is removed. The tool is distinguishable for its non-folding handle, non-telescopic shaft and non-changeable socket head portion.

U.S. Pat. No. 394,733 issued on Dec. 18, 1888, to Abram S. Staats et al. describes a curb-stop device comprising a capped stop box encasing a stopcock and having a flanged base. The box base has ways which cooperate with shoulders in the pipeline to maintain stability. The key has a long shaft with an offset handle on top and a fixed socket wrench head at the bottom. The key is distinguishable for its one-piece construction.

U.S. Pat. No. 5,138,911 issued on Aug. 18, 1992, to Wen-Rong Lan describes a telescopic wrench extensioner device comprising (1) a tubular member having a closed end portion with a longitudinal slot with multiple enlarged apertures and a polygonal axial recess for accessing a socket wrench and (2) a shaft member having a first end slidably extending into the tubular member and a second end extending out of the tubular member and being provided with an axial socket operating portion that is polygonal in cross-section to engage a wrench socket. The shaft member can be maintained at a selected position relative to the tubular member to establish a certain length of the shaft member. The device is distinguishable for its slotted construction of the telescopic shaft.

Canadian Pat. Application No. 1,147,176 issued on May 31, to Fern St. Charles describes an adjustable extension for a socket wrench having a telescoping splined shaft. The socket wrench is distinguishable for its single telescoping portion.

U.S. Pat. No. 1,759,221 issued on May 30, 1930, to Hiram J. Carson describes a mine gas shutoff cock structure employing a spring holding the large end of the tapered plug. A singular structured socket wrench with a long shaft and a perpendicular handle is disclosed. The socket wrench is distinguishable for its one-piece structure.

U.S. Pat. No. 3,691,877 issued on Sep. 19, 1972, to Joseph W. Harris describes a wrench having a pair of long handles with upper receiving recesses or apertures for pins attached to the inside opposing portions of horizontal cross-bars. The working ends of the handles are bifurcated and attached to a wrench with open jaws. The tool is operated by holding one handle stationary and moving the other handle. The tool is distinguishable for its two handle construction and fixed wrench head.

U.S. Pat. No. 1,321,776 issued on Nov. 11, 1919, to Stephen Stepanian describes a one-piece wrench for adjusting grease cups and petcocks having an elongated T-shaped handle and a flaring head member with V-shaped slots forming four finger elements with internal serrated teeth at three different levels or diameters. The tool is distinguishable for its slotted and serrated teeth structure of the flaring head member.

U.S. Pat. No. 613,652 issued on Nov. 1, 1898, to Edward J. Chadbourne describes a stopcock box and an integral long handled wrench or key with a T-shaped handle and jaws at the opposite end. The wrench is distinguishable for being one-piece.

U.S. Pat. No. 307,558 issued on Nov. 4, 1884, to Edward Lindsley et al. describes a street-box for gas and water service at surface level having two plugs which are serviced by two different keys. The first key has bifurcating handles and bifurcating prongs adjustable in diameter with a bolt. The second key has a looped handle and a square shaped distal end. The keys are distinguishable for their different structures.

U.S. Pat. No. 169,489 issued on Nov. 2, 1875, to Robert G. Smeaton describes an improvement in a multi-storied rod handle for a water stopcock wrench head which has two prongs which contact the stopcock but not the plug handle. The stopcock wrench is distinguishable for its lengthy non-telescopic handle specially designed for multi-storied buildings.

None of the above inventions and patents, taken either singly or in combination, is seen to describe the instant invention as claimed.

SUMMARY OF THE INVENTION

The invention is a versatile stopcock tool for installation of and adjusting flow in stop boxes for water, oil, gas and the like fluid materials. The tool is long, telescopic for storage, and has specific heads for different functions. A removable flashlight can be clamped onto the shaft.

Accordingly, it is a principal object of the invention to provide a versatile plumbing tool performing multiple functions with interchangeable heads.

It is another object of the invention to provide a versatile plumbing tool which is telescopic for use, storage and portage.

It is a further object of the invention to provide a versatile plumbing tool for adjusting flow in stop boxes for gas, water, oil, and the like materials.

Still another object of the invention is to provide a versatile plumbing tool for installation of stop boxes.

Yet another object of the invention is to provide a removable flashlight clamped on the shaft of the plumbing tool.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a versatile plumbing tool which has a telescopic shaft, folding handles, and removable plumbing heads for the installation of stop boxes cleaning or adjustment of stopcocks in the stop boxes. A removable flashlight can be clamped onto the shaft to illuminate the working area in the stop box.

Figure 1:
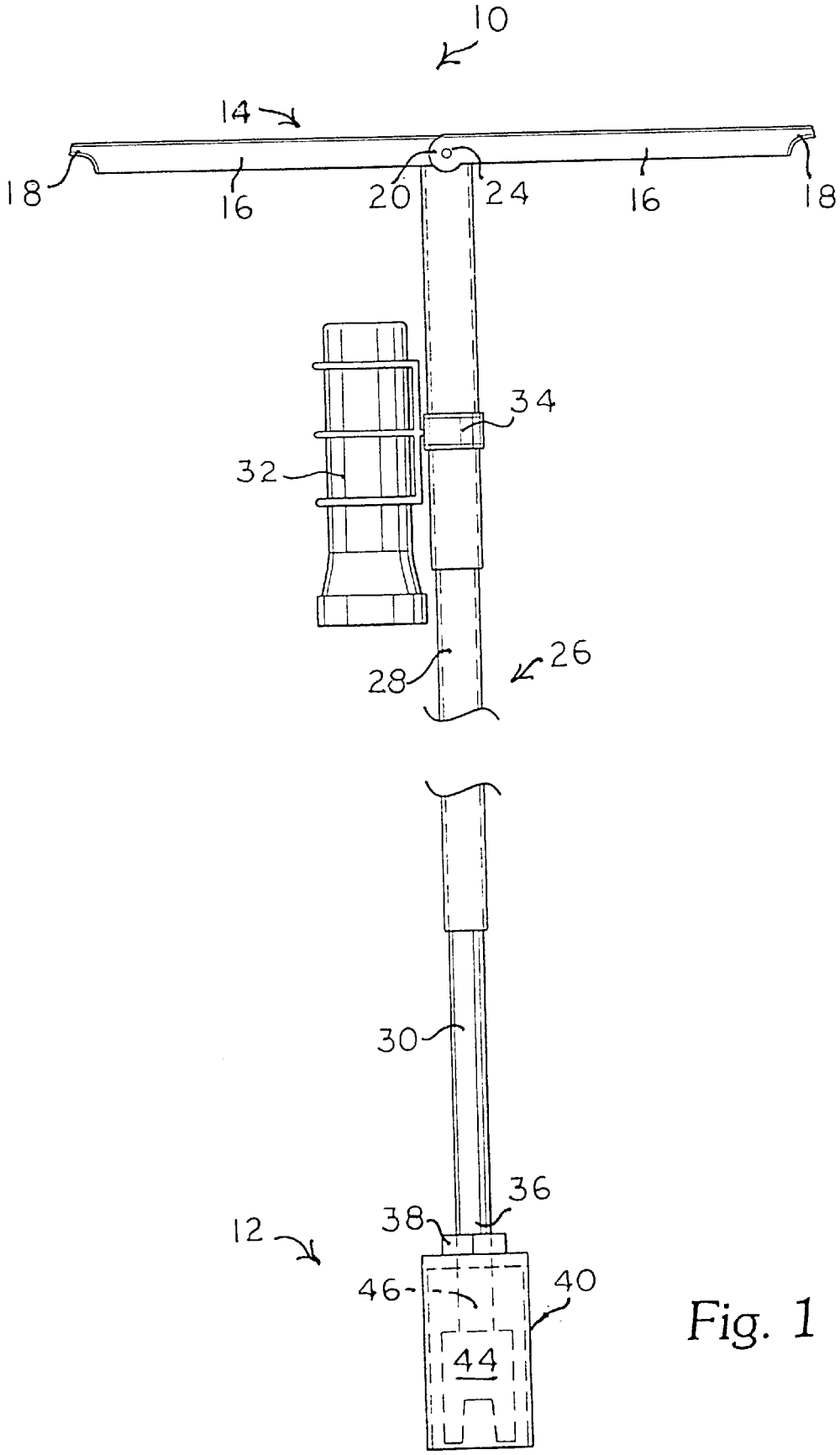
FIG. 1 is a side elevational view of a plumbing tool with a removable clamped flashlight according to the present invention with a first embodiment of a stopcock adjustment head.

In FIG. 1, an elongated foldable and telescopic stopcock tool 10 is illustrated with a first embodiment of a water valve adjusting head 12. The tool 10 has a handle 14 having two foldable arms 16. The arms 16 are substantially cylindrical with tabs 18 at their distal ends and rounded portions 20 at their proximate ends 22 which rotate about a pin 24 in the proximate end of the elongated cylindrical and telescoping shaft 26 having two telescoping sections 28 and 30. The number of telescoping sections can be increased if shaft lengths longer than approximately eight feet are contemplated. It is also within the ambit of this invention to utilize telescopic tubing for the shaft 26 which can have a cross-sectional configuration other than tubular such as a hexagonal shape or a square shape. A flashlight 32 having an adjustable wire clamp 34 is provided on the shaft 26 at any convenient point to illuminate the stopbox (not shown).

Figure 2A:
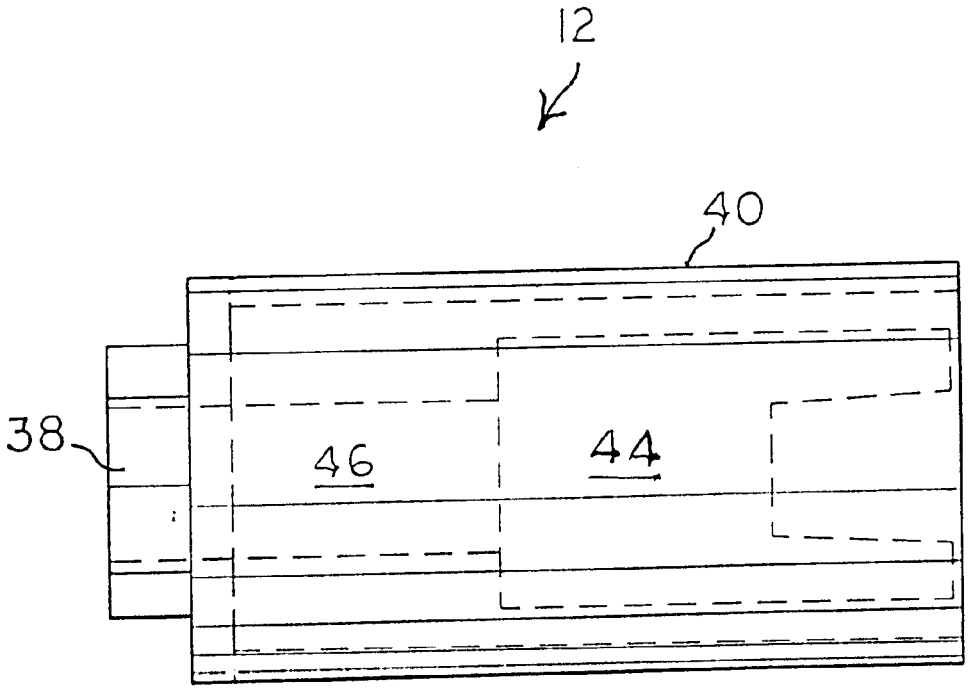
FIG. 2A is a side elevational view of the removable head in FIG. 1.
Figure 2B:
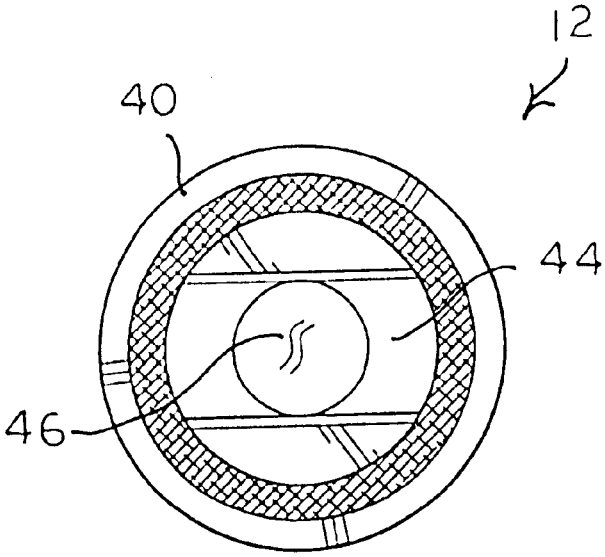
FIG. 2B is a front end elevational view of the FIG. 2A head.

The removable cylindrical socket head 12 is attachable to the socket conforming end 36 of the telescopic shaft 26 with a conventional socket joint 38. In FIGS. 2A and 2B, the enlarged views show the cylindrical locating and centering sleeve 40. The water valve adjusting head 12 is cylindrical along its longitudinal axis and has an inner slot or key 44 which would fit a conventional water valve plug (not shown). A cylindrical connector rod 46 joins the key 44 to the sleeve 38.

Figure 3A:
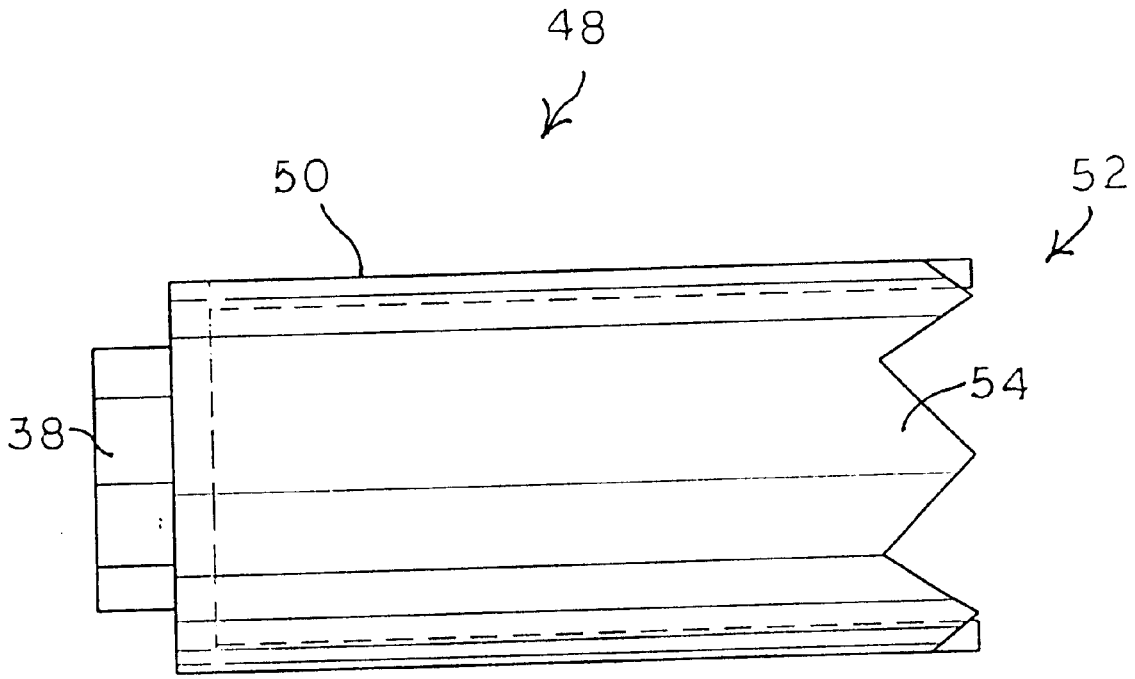
FIG. 3A is a side elevational view of a second embodiment of a removable head used for cleaning a dirty stopcock in a stop box.
Figure 3B:
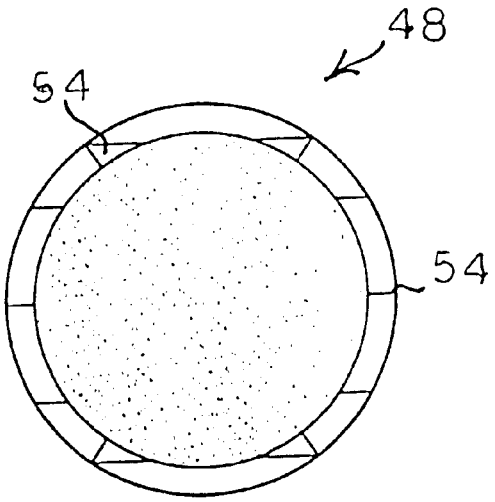
FIG. 3B is a front end elevational view of the FIG. 3A head.

In FIGS. 3A and 3B, a second embodiment of a cleaning head 48 is depicted with a tubular sleeve 50. The attachment end or socket joint 38 is located at a closed end and the open end 52 has a serrated edge 54 which effectively cleans the top portion of the water valve when the tool 10 is rotated back and forth.

Figure 4A:
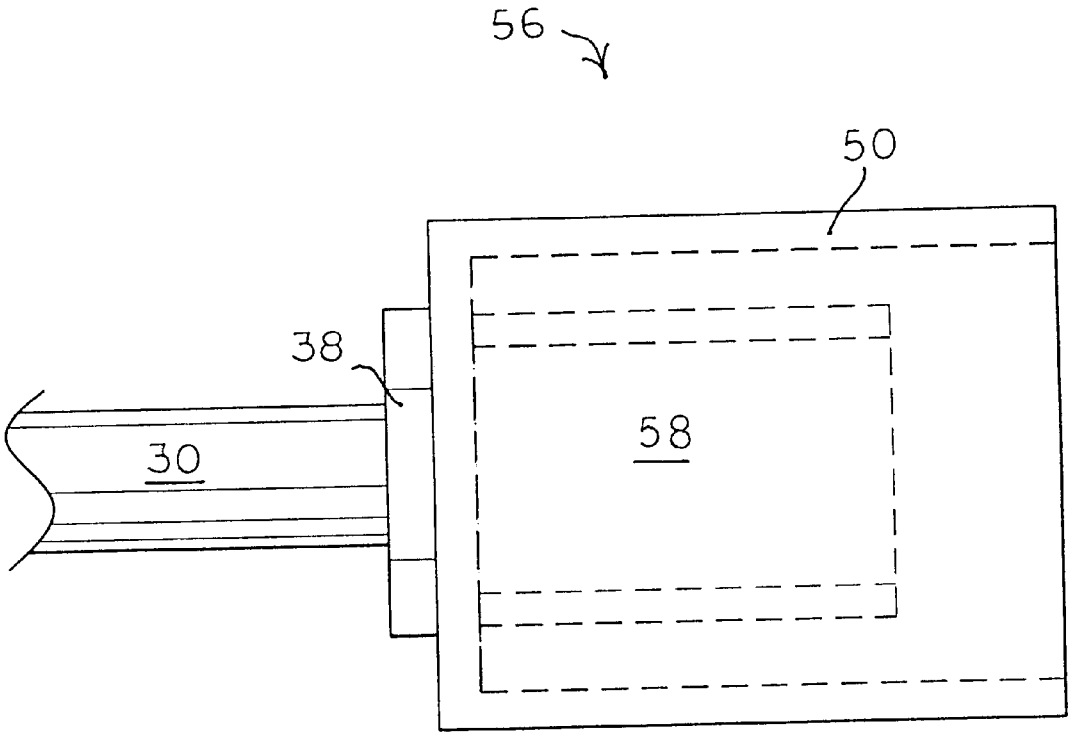
FIG. 4A is a side elevational view of a third embodiment of a removable head used for adjusting a square shaped natural gas valve.
Figure 4B:
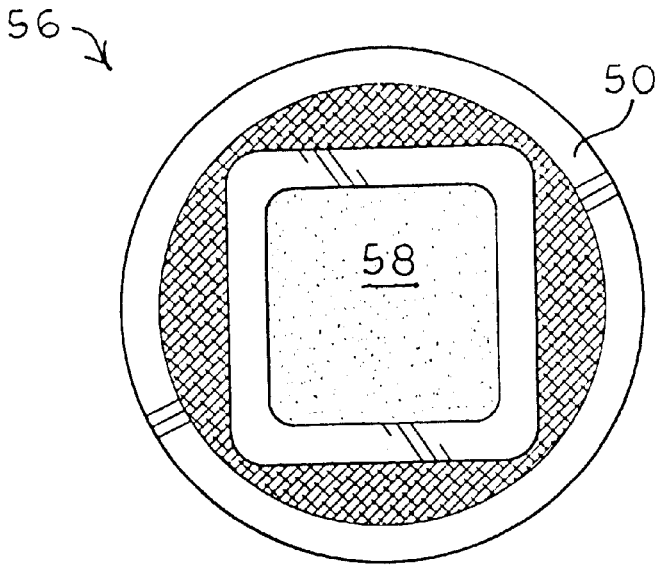
FIG. 4B is a front end elevational view of the FIG. 4A head.

In FIGS. 4A and 4B, a third embodiment of a gas valve adjustment head 56 is shown having a tubular sleeve 50, an attachment or socket joint 38, and a gas valve wrench portion 58 which is square in cross-section. The wrench portion 58 can vary in a predetermined size range from 0.5 to 1.5 inches along one side.

Thus, a versatile stop box plumbing tool has been shown which is telescopic in length and having interchangeable heads for multiple functions. The tool can also be portaged and stored readily by virtue of folding handles.

It is to be understood that the present invention is not limited to the embodiments described above, but encompasses any and all embodiments within the scope of the following claims.

We claim:

1. An elongated foldable and telescopic stopcock tool comprising:

a folding tool handle having two foldable arms of equal length;

an elongated telescopic rotatable shaft perpendicularly connected to said folding tool handle, said shaft having a socket conforming end;

a removable flashlight affixable to said shaft by an adjustable wire clamp, said flashlight rotating with the rotatable shaft; and a removable cylindrical socket head attachable to said socket conforming end of said shaft, said socket having a cylindrical locating and centering sleeve body with a socket joint on one end connected by a connector rod to an inner key for fitting a water valve plug and installation of stopcocks.

2. The stopcock tool according to claim 1, wherein said shaft has a tubular circular cross-section.

3. The stopcock tool according to claim 1, wherein said shaft has a tubular hexagonal shaped cross-section.

4. The stopcock tool according to claim 1, wherein said shaft has a tubular square shaped cross-section.

5. An elongated foldable and telescopic stopcock tool comprising:

a folding tool handle having two foldable arms of equal length;

an elongated telescopic rotatable shaft perpendicularly connected to said folding tool handle, said shaft having a socket conforming end;

a removable flashlight affixable to said shaft by an adjustable wire clamp, said flashlight rotating with the rotating shaft; and a removable cylindrical socket head attachable to the socket conforming end of said shaft, wherein the socket head is a cylindrical tubular sleeve having a socket joint on one end and an open opposite end having a serrated edge for cleaning a top portion of a water valve.

6. The stopcock tool according to claim 5, wherein said shaft has a tubular circular cross-section.

7. The stopcock tool according to claim 5, wherein said shaft has a tubular hexagonal shaped cross-section.

8. The stopcock tool according to claim 5, wherein said shaft has a tubular square shaped cross-section.

9. An elongated foldable and telescopic stopcock tool comprising:

a folding tool handle having two foldable arms of equal length;

an elongated telescopic rotatable shaft perpendicularly connected to said folding tool handle, said shaft having a socket conforming end;

a removable flashlight affixable to said shaft by an adjustable wire clamp, said flashlight rotating with the rotatable shaft; and a removable cylindrical socket head attachable to the socket conforming end of said shaft, wherein the socket head is a cylindrical tubular sleeve having a socket joint on one end and an opposite end having a gas valve wrench which has an inset square cross-section for adjusting the gas valve in a stopcock.

10. The stopcock tool according to claim 9, wherein said shaft has a tubular circular cross-section.

11. The stopcock tool according to claim 9, wherein said shaft has a tubular hexagonal shaped cross-section.

12. The stopcock tool according to claim 9, wherein said shaft has a tubular square shaped cross-section.

* * * * *